United States Patent [19]

Manfroy et al.

[11] 4,274,599

[45] * Jun. 23, 1981

[54] ORE GRINDING PROCESS INCLUDING A GRINDING AID OF AN ANIONIC POLYELECTROLYTE

[75] Inventors: Willy Manfroy, Carmel, Ind.; Richard R. Klimpel, Midland, Mich.

[73] Assignee: The Dow Chemical Company, Midland, Mich.

[ * ] Notice: The portion of the term of this patent subsequent to Jan. 30, 1996, has been disclaimed.

[21] Appl. No.: 932,871

[22] Filed: Aug. 11, 1978

Related U.S. Application Data

[63] Continuation-in-part of Ser. No. 853,737, Nov. 21, 1977, abandoned, which is a continuation-in-part of Ser. No. 805,252, Jun. 10, 1977, abandoned.

[51] Int. Cl.[3] ..... B02C 23/18

[52] U.S. Cl. ..... 241/16; 51/298; 51/306; 51/316

[58] Field of Search ..... 241/15, 16, 18, 20, 241/30; 252/8.5 C, 8.5 R; 51/316, 298, 306

[56] References Cited

U.S. PATENT DOCUMENTS

| | | | |
|---|---|---|---|
| 2,740,522 | 4/1956 | Almone et al. | 241/16 |
| 2,905,565 | 9/1959 | Dietz | 241/16 |
| 3,104,068 | 9/1963 | Castelli | 241/16 |
| 3,534,911 | 10/1970 | Gwilliam | 241/16 |
| 3,542,575 | 11/1970 | Nelson | 241/16 |
| 3,549,091 | 12/1970 | Slepetys | 241/16 |
| 3,604,634 | 9/1971 | Windle | 241/16 |
| 3,686,111 | 8/1972 | Makhlouf et al. | 241/18 |
| 3,923,717 | 12/1975 | Lalk et al. | 106/90 |
| 4,136,830 | 1/1979 | Manfroy et al. | 241/16 |
| 4,162,044 | 7/1979 | Manfroy et al. | 241/16 |

FOREIGN PATENT DOCUMENTS

| | | | |
|---|---|---|---|
| 47200 | 4/1974 | Australia | 241/16 |

OTHER PUBLICATIONS

"Chem. Enhancement of Ore Grinding Effiency," Hartley et al, Aug. 5-7, 1976, Pacific N.W. Laboratories, Vail, Colo.

"Crushing and Grinding," Lowrison, pp. 106-110, 1974, CRC Press Inc., Cleveland, Ohio.

"Computers and Operations Research in Mineral Industry", Manfroy et al., Oct. 4-8, 1976, 14 Int. Symposium.

*Primary Examiner*—Donald J. Arnold

[57] ABSTRACT

A process for grinding coal or ores containing metal values comprising carrying out said grinding in a liquid medium and with a grinding aid comprising an anionic polyelectrolyte dispersible in the liquid medium and having a hydrocarbon backbone and a plurality of pendant anionic groups, said grinding aid being present in an amount effective to provide increased grinding efficiency.

21 Claims, 1 Drawing Figure

ORE GRINDING PROCESS INCLUDING A GRINDING AID OF AN ANIONIC POLYELECTROLYTE

CROSS-REFERENCE TO RELATED APPLICATIONS

This application is a continuation-in-part of our copending application Ser. No. 853,737, filed Nov. 21, 1977, now abandoned, which in turn is a continuation-in-part of our application Ser. No. 805,252, filed June 10, 1977, now abandoned.

BACKGROUND OF THE INVENTION

This invention relates to the wet grinding or coal or ores containing metal values with a grinding aid.

The wet grinding of mineral ores is employed as an intermediate process in the extraction of metals from their ores. The process is one which increases the surface area of the material and also, by reduction of the average particle size of the mineral, facilitates subsequent process steps, e.g., flotation separation or chemical treatment. Grinding operations for ores or coal are usually carried out in mills such as ball, bead, rod or pebble mills, depending upon the degree of comminution required. Autogenous grinding is also employed.

In the processing of ores, the essential step is the comminution of the ore down to the size at which valuable metal grains are released from the gangue matrix. With the inevitable trend towards working of lower-grade ore deposits, the amounts of metals liberated tend to decrease and the grinding cost per ton of product increases. This factor along constitutes a considerable fraction of the overall cost of winning and the increase in cost of energy has made grinding costs a very significant factor in operations for recovering valuable metals.

The amount of breakage per unit of time (breakage kinetics) and mass transfer of grinding mineral ores are usually controlled by the addition and removal of water, an excellent medium because of its high polarity, to the mill. When the mass transport of the slurry through the mill decreases, the mill operator takes corrective action by either decreasing the solids feed rate and/or temporarily increasing the amount of water entering the mill. While both actions will prevent the mill from overloading, mill efficiency is reduced because fewer solids are ground per unit of time under such conditions.

Additionally, it is well known that the traditional tumbling mill apparatus used for wet-grinding ores are extremely inefficient in energy utilization, wasting (based on theoretical bond breakage energies) perhaps as much as 90% or more of the energy supplied to the mill. Therefore, even small increases of a few percent in the reduction of size distribution of ore particles and an increase in throughput of ore ground per unit of time would significantly improve the efficiency of grinding and cost of mill operations, especially with respect to energy utilization.

While various methods and chemical agents that act as grinding aids have been employed in efforts to increase grinding efficiencies and economics, these efforts have at least been only partially beneficial and many have even proved to be contradictory in related downstream processing operations. Various chemical agents, e.g., dispersants, surfactants, polysiloxane, organosilicones, glycols, amines, graphite, non-polar liquids and the like have all been utilized and may increase the rate of grinding by preventing particle agglomeration. However, as reported in Perry's Chemical Engineering Handbook, 5th Ed. 1973, at Sec. 8–12, there really is no scientific method of choosing the most effective surfactant. Rather, surfactant lists and kits that can be used for systematic trails are made available.

Certain polyelectrolytes have also been employed in grinding operations. For example, polyacrylic acid materials have been used in the dry grinding of Bentonite (U.S. Pat. No. 3,220,946) and as dispersing agents in the wet grinding of chalk, fillers and pigments (U.S. Pat. Nos. 3,604,634 and 3,934,825 are representative) for particle size reduction. However, none of these operations concern the grinding of coal or mineral ores for liberation of metal values. U.S. Pat. No. 3,950,182 teaches the grinding of coal, fillers and metal ores, the operations being carried out with ionic polysaccharides, such as sodium carboxymethyl cellulose. U.S. Pat. No. 3,252,662 concerns the grinding of metal ores with a deflocculating agent comprising linear condensed phosphates, preferably sodium tripolyphosphate.

SUMMARY OF THE INVENTION

The present invention provides a process for grinding coal or ores containing metal values and comprising carrying out the grinding operation in the presence of a liquid medium and a grinding aid comprising an anionic polyelectrolyte dispersible in the liquid medium and having a hydrocarbon backbone and a plurality of pendant anionic groups, said polyelectrolyte being employed in an amount effective to provide increased grinding efficiency. The use of such grinding aids results in a substantial increase in the rate of particle breakage and permits higher density (solids) slurries of coal or ore to be ground, thereby achieving a greater volume throughput of solid ground per unit of time with a corresponding increase in the recovery rates of the desired metal value where ores are ground. The resulting improved efficiency in the overall grinding operation, i.e., in the use of mill capacity and particularly in the consumption of energy per unit of product, is achieved with the present grinding aids without encountering a decrease in grinding kinetics normally observed when higher density slurries are ground.

It has also been found that the polyelectrolyte grinding aids of the present invention usually do not detrimentally effect downstream processing operations which are performed, particularly on mineral ores, after the mineral leaves the grinding mill. Thus, for example, the polyelectrolyte grinding aids generally do not detrimentally effect processes such as, for example, froth flotation processes in which select metal values such as copper, lead, zinc or gold are recovered from the ore with the aid of flocculating and deflocculating agents. Neither do the polyelectrolyte grinding aids of the present invention have any counterproductive effects in subsequent operations such as, for example, in pelletizing iron ore. Further, since the polyelectrolytes are adsorbed on the solids, the polyelectrolytes do not contribute to any downstream pollution problems upon discharge of the aqueous medium such as might be the case with phosphatic grinding said, for example.

DETAILED DESCRIPTION OF THE INVENTION

Figure 1:
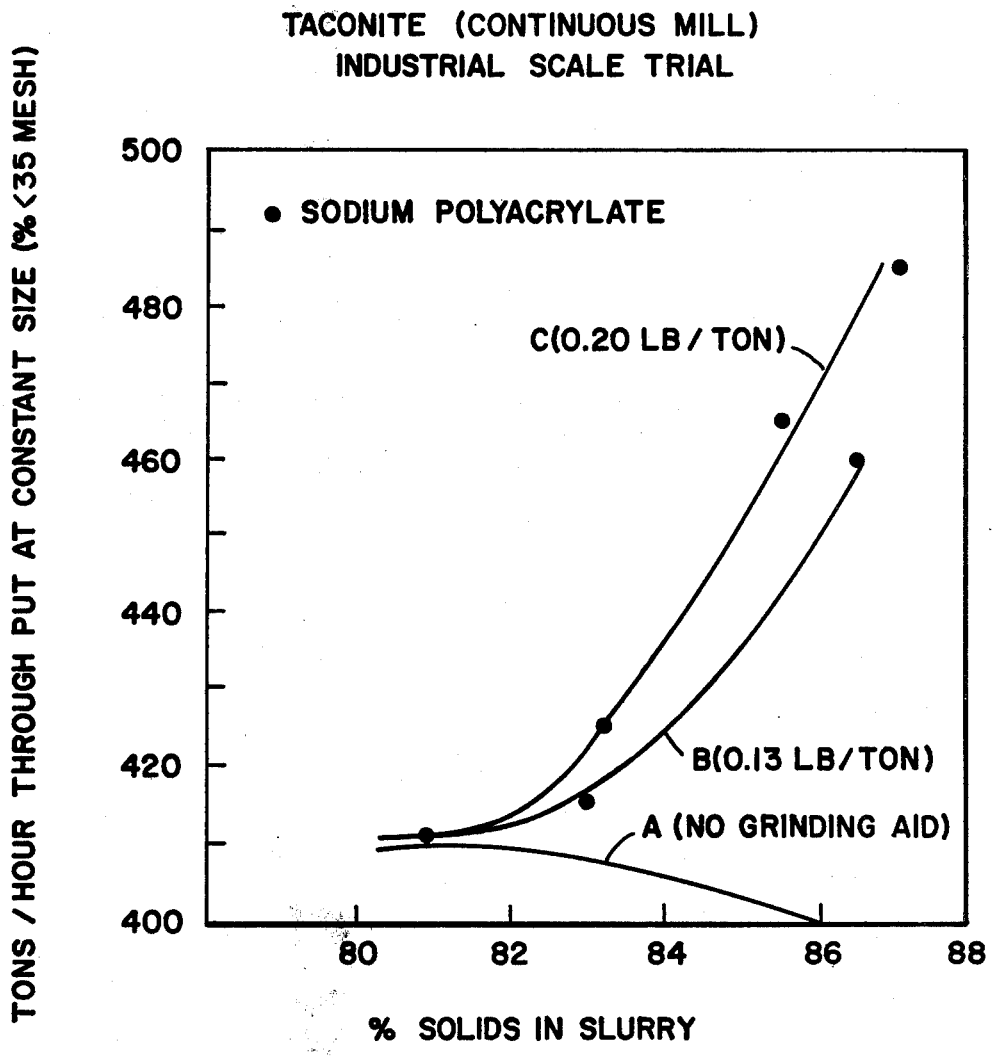

The method of the present invention is preferably carried out in the presence of a polar liquid medium in which the grinding aid is sufficiently dispersible to produce an improvement in grinding efficiency, although the use of a liquid medium comprising a liquid which itself is not a solvent for the grinding aid may be feasible provided that a solvent or dispersant for the grinding aid is also present. The term dispersible thus means those grinding aids which are soluble or dispersible in the medium employed to an extent sufficient to provide adsorption thereof on the particles and improved grinding efficiency. Water is the preferred medium. The concentration of the solids, e.g., ore or coal, in the liquid medium may vary within wide limits and is usual to operate with a slurry solids content in the range of from about 40 to about 95, preferably about 50 to about 90, more preferably from 65 to about 88% and most preferably from 70 to about 88, percent by weight of the slurry.

Metal ores which may advantageously be treated according to the present invention include iron, copper, gold, silver, lead, zinc, nickel and the like which can be subjected to a wet-grinding treatment. In a preferred embodiment, an ore containing a metal value is ground according to the process of the invention. In another embodiment, coal is preferably ground according to the invention process. The grinding aid is preferably a polyelectrolyte having a polyethylenic backbone and sufficient pendant anionic groups to inherently render the polyelectrolyte dispersible in the liquid medium employed, e.g., without the aid of surfactants.

Grinding efficiency is determined from the amount of particulate solid of particle size less than 325 mesh (44 micrometers) U.S. Standard, that can be formed from a given liquid slurry of constant volume of liquid and ore solids using the same energy input. Normally, as the weight percent of ore solids in this slurry is increased, the grinding efficiency of the grinding medium is reduced. Thus, it is critical in the practice of this invention that the amount of polyelectrolyte grinding aid employed be sufficient to reverse the trend towards a lower grinding efficiency as weight percent concentration of ore solids in the slurry is increased.

The polyelectrolyte grinding aid used in the present invention is suitably any inherently liquid dispersible polyelectrolyte having a hydrocarbon (preferably polyelectric) backbone bearing a plurality of pendant suitable anionic groups.

A suitable anionic group of the polyelectrolyte grinding aid has a pKa of about 8 or less, preferably about 6 or less, wherein pKa is negative logarithm of the acidity constant for the acidic (anionic) group. The anionic group is preferably a carboxylate or sulfonate group or a precursor thereof such as an anhydride, an ammonium or an alkali metal salt of an acid or an ester. However, when an ester group is employed, the conditions of use must be sufficient to hydrolyze the ester to the acid.

It has been found that the effectiveness of the polyelectrolyte grinding aid relates to the number of anionic groups in the polyelectrolyte. In one means of determination, the number is found to be sufficient if the polyelectrolyte effects a minimum 10% reduction in the low shear viscosity of a slurry when the polyelectrolyte is added to the slurry in an amount sufficient to provide a concentration of 0.06 weight percent of polyelectrolyte based on total mineral solids. By low shear viscosity is meant Brookfield viscosity determined with a Brookfield viscometer using a #D bar at 25° C. and 5 rpm. By slurry it is meant that coal or a mineral is ground to an average particle size of less than 325 mesh and that the concentration of solids in the liquid medium is between about 50 to about 95% by weight. Preferred polyelectrolytes effect at least about a 20% viscosity reduction under such conditions, with the most preferred effecting a viscosity reduction of at least about 40%. So long as viscosity reductions in this range are effected, the number of anionic groups in the polyelectrolyte is not particularly critical. However, as a general rule, the polyelectrolytes advantageously employed have a proportion of anionic groups in the polyelectrolyte such that there are from about 1 to about 14, preferably from about 2 to about 12, milliequivalents of anionic moiety per gram of the polyelectrolyte.

Exemplary polyelectrolyte include the water dispersible polymers or copolymers or salts thereof of anionic monomers such as alpha,beta-ethylenically unsaturated acids including, for example, acrylic, methacrylic, fumaric, maleic, crotonic, itaconic or citraconic acids; partial esters of alpha,beta-ethylenically unsaturated polycarboxylic acids, e.g., methyl acid maleate, ethyl acid fumarate; N-sulfoalkyl derivatives of alpha,beta-ethylenically unsaturated amides such as, for example, N-(sulfomethyl)acrylamide or N-(sulfomethyl)methacrylamide; the sulfoalkyl esters of alpha,beta-ethylenically unsaturated carboxylic acids such as 2-sulfoethylmethacrylate or 2-sulfoethylacrylate; or other sulfonated monomers such as alpha,beta-ethylenically unsaturated aromatic sulfonic acids, e.g., styrene sulfonic acid or vinyl toluene sulfonic acid. Also included are sulfonated monovinylidene aromatic polymers such as sulfonated polystyrene or sulfonated poly(vinyl)-toluene; or sulfonated aliphatic monoolefinic polymers such as, for example, sulfonated polyethylene.

It is understood that such water dispersible polymers or copolymers or salts thereof can be either derived by polymerizing, to the extent possible as will be recognized by those skilled in the art, the above specified monomers alone or along with other vinyl monomers such as monovinylidene aromatics, e.g., styrenes; aliphatic monoolefins such as, for example, ethylene, propylene, butene-1, isobutene, and dienes such as, for example, butadiene or isoprene; the alkyl esters of the alpha,beta-ethylenically unsaturated carboxylic acids such as, for example, ethylacrylate or methylmethacrylate; vinyl esters such as, for example, vinylacetate, vinylpropionate, vinylbenzoate; vinylchloride or vinylidene chloride; ethylenically unsaturated amides such as acrylamide or methacrylamide; or acrylonitrile or methacrylonitrile.

Examples of polyelectrolytes of particular interest are the polymers of acrylic or methacrylic acid including the monovalent metal or ammonium salts thereof, e.g., sodium polyacrylate or acrylamide/acrylate copolymer which may be derived from the partial hydrolysis of polyacrylamide. Of further particular interest are the polymers of N-(sulfoalkyl)acrylamide or N-(sulfoalkyl)methacrylamide including the monovalent metal or ammonium salts thereof, e.g., the sodium salt of N-(sulfomethyl)acrylamide or the salt of N-(sulfomethyl)methacrylamide. Of further particular interest are the water soluble salts of sulfonated polystyrene or sulfonated polyvinyl toluene in which the salt may be alkali metal or ammonium salts. Of further particular interest are the copolymers of styrene with maleic anhydride (post-hydrolyzed, containing at least about 17 mole % maleic anhydride), itaconic acid or citraconic acid including the metal salts thereof, e.g., the sodium salt of styrene maleic anhydride. Also of particular interest are the polymers of sulfoethylmethacrylic acid including the metal salts thereof, e.g., the sodium salt of sulfoethylmethacrylic acid.

Of the foregoing polymers the sodium polyacrylate and the styrene maleic anhydride are preferred with the sodium polyacrylate most preferred.

Those skilled in the art will recognize that some ethylenically unsaturated polymers, such as, for example, polyacrylamide, are sometimes characterized by a greater or lesser degree of hydrolysis, i.e., contain some free carboxyl groups. This condition is dependent upon the method of manufacture of the polymer, the presence or absence of other minor ingredients in the starting monomer, e.g., acrylic acid, conditions of storage, or the like. The polymer products appear to be equivalent whether the carboxyls result from copolymerization of acrylamide with acrylic acid or from hydrolysis of amide groups subsequent to polymerization of copolymerization of acrylamide with acrylic acid or from hydrolysis of amide groups subsequent to polymerization or copolymerization and grinding aid products resulting from either method are within the scope of the invention. Other additives, such as triethanolamine, for example, can also be added with the polyacrylic or methacrylic acid polymer as long as the resulting product contains about 50 weight percent or more of the polyacrylic or polymethacrylic acid moiety.

The polymers and copolymers described herein are commercially available in various forms and molecular weights and can be prepared by those skilled in the art according to a variety of known procedures.

Preferably, the grinding aids are employed in the form of water soluble salts, e.g., alkali metal salts, such as, for example, sodium or potassium, or ammonium salts of the homopolymers or copolymers. The homopolymers are preferably employed as grinding aids.

The polymeric grinding aids used in the present invention have average molecular weights ranging from about 200 to about 100,000. Preferably, the grinding aids are in a molecular weight (as determined by the Mark Houwink equation) range of from about 1000 to about 60,000 and more preferably have an average molecular weight of from about 2000 to about 20,000. It should be understood that the molecular weight can vary over a wide range and is not critical as long as the conditions previously set forth in the selection of the particular polyelectrolyte are met. High molecular weight polymers are sometimes difficult to dissolve, but colloidal dispersions thereof can be formed. Polyelectrolytes which are insoluble or non-dispersible in the medium are, of course, not within the scope of the invention.

The polyelectrolyte grinding aids which are preferred in the present invention are made by methods well known in the art and do not form any part of the present invention and are thus not described in detail.

The amount of grinding aid employed to increase grinding efficiency, e.g., increase the rate and type of ore-particle breakage, e.g., ore classification, which can respectively be described as the "selection" and "distribution" functions of grinding, will vary depending upon certain factors including properties which are unique to coal or each ore. For example, the "selection function", which describes the probability that a particle of any particular size will be broken in a given unit of time, will be affected by any factors which change the probability of particle breakage. Factors such as, for example, mill type, slurry volume, number and size of grinding media (e.g., balls or rods), raw ore particle size, mill rpm or ore properties, all effect the probability of successful particle breakage. The properties unique to each ore also effect the "distribution function", that is, the number and size distribution of fragments into which a particle will subdivide when it is broken. Measurement of the number and size distribution of fragments after grinding will allow the calculation of the effect of the aid on the selection and distribution functions which will indicate the effectiveness of the grinding aid added. Further reference to the use of selection and distribution functions in determining the effect of grinding aid materials in wet grinding process can be found in Klimpel, R. R., and Manfroy, W., "Computer Analysis of Viscosity Effects on Selection for Breakage and Breakage Distribution Parameters in the Wet Grinding of Ores", *14th Int. Sym. on Appl. of Computers in the Mineral Ind.*, Pennsylvania State U., University Park, Pa., Oct. 1976;

Klimpel, R. R., and Manfroy, W., "Grinding Aids for Increased Throughout", *Symposium of Canadian Min. Proc.*, Ottawa, Canada, Jan. 1977;

Klimpel, R. R., and Manfroy, W., "Development of Chemical Grinding Aids and Their Effect on Selections-for-Breakage and Breakage Distribution Parameters in the Wet-Grinding of Ores", *Proc. 12th Int. Min. Proc. Congress*, Aug.-Sept. 1977, Sao Paulo, Brazil.

The liquid slurry preferably contains grinding media wherein the media are as employed in large ore grinding mills such as ball, bead, rod or pebble mills. The media are generally of a size large enough where they do not contribute to an increase in the inherent viscosity of the slurry. Thus, the type of mills under consideration here are distinct from those mills in which paint pigments are ground to an extreme fineness with an extremely small granular grinding medium.

Generally, the effective amount of grinding aid employed to increase the rate of ore grinding can be as low as about 0.002% by weight of active polyelectrolyte, based on the dry weight of the coal or ore present. The maximum amount of grinding aid employed is usually limited by economic constraints, i.e., the high cost of the chemical grinding aid. Preferably, the grinding aids of the present invention are employed in the range of from about 0.003 to about 0.08% by weight and most preferably in the range of from about 0.01 to about 0.04% by weight of active polyelectrolyte. (About 0.03 to about 0.8 mg/gm of ore, preferably about 0.1 to about 0.4 mg/gm). The optimum amount of grinding aid from an economic and/or utility viewpoint will, of course, depend upon, inter alia, the particular material to be ground and various other factors, as described hereinabove.

In batch operations, grinding periods of from 5 to 10 minutes or longer are usually sufficient to measure an increase in the fineness of grind when using a grinding aid as taught herein. In open cycle continuous grinding operations, the increased throughput and/or increased fineness of grind at constant throughput is readily ascertained. In continuous closed cycle grinding operations, however, much of the ore being ground is continuously recycled through the grinder until the desired degree of fineness is obtained and the actual grinding time per unit of ore can only be calculated on an average residence basis. This will vary with the type of ore used and the amount of grinding required to meet size distribution requirements. With iron ore, for instance, grinding must be continued until the particle size is less than 325 mesh (U.S. standard), sometimes less than 500 mesh. Again, those skilled in the art of grinding will be able to ascertain the grinding time needed.

Increases in grinding kinetics are determined by measuring the change in the weight and size distribution of fragments obtained per unit of time. An increase in the amount of grinding or fineness of grind as determined by measurement of the particle sizes resulting per unit grinding time means that more grinding takes place. Illustrating the increased grinding rates achieved in another manner, it is readily apparent that if a grinding viscosity of, for example, 50,000 cps is desired and the untreated ore slurry is at 68% solids, one can grind a higher solids density slurry of, for example, 72% solids, by use of a grinding aid without any change in grinding conditions. Increases in throughput or fineness of grind of even a percent or two, are highly desirable as they represent significant savings in unit energy costs. According to the methods of the present invention, experimental data indicates that increases of from 1 to 20% of the grinding throughput and/or a 1 to 10% increase in fineness or grind of a specific ore particle size at constant throughput can be achieved with the use of the grinding aids taught herein.

In determining the usefulness of a particular agent as a grinding aid, various chemicals are first screened to determine the ability of a particular chemical agent to increase the fluidity of a finely ground ore. Those agents generally found to decrease the viscosity of the ore (ground to a particle size of 325 mesh and having a solids concentration between 50 to 95% by weight) by 20 to 25% or more are usually subsequently found to be very effective as grinding aids. Generally, the greater the decrease in slurry viscosity, the greater the increase in grinding. However, viscosity data alone is not always sufficient by itself to predict that any increase in grinding efficiency will necessarily result or to indicate the degree of an increase in grinding efficiency which might be obtained. This will have to be determined by actual grinding trials. In carrying out actual grinding tests, an ore sample is first ground in a typical ball mill using plain water as a liquid phase. After each grinding run of a predetermined time, the size distribution of the product is determined by wet screening. Enough runs are made with different grinding periods and slurry concentrations so that the change in the weight and size of fragments can be determined. The runs are then repeated incorporating a grinding aid into the slurry and making the same determinations. The change in the size and weight of fragments as compared with the control runs indicate the effectiveness of the grinding aid.

The following examples are presented to illustrate the invention, but are not to be construed as limiting it in any manner whatsoever. The ore slurry percent is based on the weight of solids present in the slurry being treated and the milligrams per gram is based upon the number of milligrams of actual grinding aid per gram of ore.

EXAMPLE 1

Various chemical agents were screened to determine the effectiveness thereof in decreasing the viscosity of a finely-ground ore. In such operations, ground ore was mixed with sufficient water to form a viscous slurry, usually between about 100,000 and 150,000 cps. The viscosity of the slurries was measured with the use of a Brookfield viscometer fitted with a crossbar and helipath stand, the helipath slowly moving the revolving crossbar (at 5 rpm) vertically so that the bar continuously encounters undisturbed slurry. A base viscosity curve of untreated slurry is first determined. Then a dilute solution of the test agent is added in 5 small equal increments of 1 cc each to the slurry. The viscosity change is plotted as a function of treatment level and the results compared with the untreated slurries.

In such operations, the viscosity of sluries treated with various levels (mg/gm of ore) of sodium polyacrylate and copolymers of sodium polyacrylic and acrylamide were found to be decreased as compared with control samples:

TABLE I

| Ore | Aid | mg/gm | % Decrease Slurry Viscosity |
|---|---|---|---|
| 1. Taconite[a] | Na polyacrylate | 0.2 | 40 |
| 2. Taconite[b] | " | " | 31 |
| 3. Copper[c] | " | " | 42–68[d] |
| 4. Gold | " | " | 75 |
| 5. Iron[e] | " | " | 57 |
| 6. Copper[f] | " | " | 32–47[d] |
| 7. Copper[g] | " | " | 68 |
| 8. Gold | " | " | 58–65[d] |
| 9. Iron[e] | [h]Na salt 25 mole % acrylamide 75 mole % polyacrylate | | 50–55 |
| 10. Iron[b] | [h]Na salt 25 mole % acrylamide 75 mole % polyacrylate | " | 42 |
| 11. Copper[f] | [h]Na salt 25 mole % arrylamide 75 mole % polyacrylate | " | 27–47[d] |
| 12. Copper[g] | [h]Na salt 25 mole % acrylamide 75 mole % polyacrylate | " | 68 |
| 13. Gold | [h]Na salt 25 mole % acrylamide 75 mole % polyarrylate | " | 70–75[d] |

[a]Eveleth
[b]Sherman
[c]Duval
[d]range of several samples
[e]Hanna
[f]Morenci
[g]Kingman
[h]polyacrylamide hydrolyzed to 75 mole % carboxylic acid Substantial decreases in viscosity were also obtained with other concentrations and other polyacrylate-acrylamide copolymers in ratios of 1:1 and 1:3. Subsequent evaluations of those agents substantially reducing the viscosity of the ore slurries in ore grinding operations at the same or lower concentrations indicated surprising and significant increases in grinding kinetics.

EXAMPLE 2

In additional such operations utilizing the procedures of Example 1 and materials such as styrene maleic anhydride. N-(sulfomethyl)polyacrylamide (% Mannich-reacted indicating degree to which available amide groups were reacted), sulfonated polystyrene, 3-sulfoethyl polymethacrylate and copolymers thereof with acrylamide, the viscosities of the slurries treated therewith were found to be decreased as compared with control samples. Such data are reported in the following Tables II–V:

TABLE II

| | Ore | Aid | mg/gm | % Decrease Slurry Viscosity |
|---|---|---|---|---|
| 1. | Taconite[a] | A | 0.2 | 23 |
| 2. | Taconite[b] | " | " | 50 |
| 3. | Gold | " | " | 19 |

TABLE II-continued

| | Ore | Aid | mg/gm | % Decrease Slurry Viscosity |
|---|---|---|---|---|
| 4. | Iron[c] | B | 1.0 | 60 |
| 5. | Copper[d] | " | " | 30 |
| 6. | Copper[e] | " | " | 43 |
| 7. | Iron[b] | " | " | 57 |

A = Styrene maleic anhydride copolymer, m.w. 2000, 1:1 mole ratio, disodium salt form.
B = Styrene maleic anhydride copolymer, m.w. 2000, 1:3 mole ratio, disodium salt form.
[a]Eleveth
[b]Sherman
[c]Hanna
[d]Morenci
[e]Kingman

TABLE III

| | Ore | Aid | mg/gm | % Decrease Slurry Viscosity |
|---|---|---|---|---|
| 1. | Taconite[a] | A | 0.2 | 25 |
| 2. | Taconite[b] | C | " | 58 |
| 3. | Copper[c] | " | " | 40 |
| 4. | Gold | " | " | 59 |
| 5. | Iron[e] | " | " | 27 |
| 6. | Iron[e] | B | " | 29 |
| 7. | Copper[f] | A | " | 16 |
| 8. | Copper[f] | B | " | 14 |
| 9. | Copper[g] | A | " | 18 |
| 10. | Copper[g] | B | " | 26 |
| 11. | Gold | A | " | 90 |
| 12. | Gold | B | " | 92 |
| 13. | Iron[b] | A | " | 42 |
| 14. | Iron[b] | B | " | 54 |
| 15. | Copper[f] | C | " | 32 |
| 16. | Gold | C | " | 87 |

[a]Eleveth
[b]Sherman
[c]Duval
[e]Hanna
[f]Morenci
[g]Kingman
A = poly N-(sulfomethyl)acrylamide (25 mole % of the amide groups substituted with sulfomethyl)
B = poly N-(sulfomethyl)acrylamide (75 mole % of the amide groups substituted with sulfomethyl)
C = poly N-(sulfomethyl)acrylamide (100 mole % of the amide groups substituted with sulfomethyl)

TABLE IV

| | Ore | Aid | mg/gm | % Decrease[a] Slurry Viscosity |
|---|---|---|---|---|
| 1. | Taconite[b] | *Sulfonated Polystyrene | 0.2 | 32 |
| 2. | Copper[c] | *Sulfonated Polystrene | " | 42–43[d] |
| 3. | Iron[e] | *Sulfonated Polystrene | " | 33 |
| 4. | Iron[e] | *Sulfonated Polystyrene | " | 25 |
| 5. | Copper[f] | *Sulfonated Polystyrene | " | 24 |
| 6. | Iron[e] | *Sulfonated Polystyrene | " | 20 |
| 7. | Iron[e] | *Sulfonated Polystrene | " | 20 |
| 8. | Iron[g] | *Sulfonated Polystyrene | " | 46 |
| 9. | Iron[e] | *Sulfonated Polystyrene | 1.0 | 38 |
| 10. | Copper[f] | *Sulfonated Polystyrene | " | 58 |
| 11. | Iron[g] | *Sulfonated Polystrene | " | 78 |

TABLE IV-continued

| | Ore | Aid | mg/gm | % Decrease[a] Slurry Viscosity |
|---|---|---|---|---|

[a]as compared with control
[b]Eleveth
[c]Duval
[d]range of several samples
[e]Hanna
[f]Morenci
[g]Sherman
*Sodium salt of low molecular weight, 100% mole sulfonated.

TABLE V

| | Ore | Aid | mg/gm | % Decrease Slurry Viscosity |
|---|---|---|---|---|
| 1. | Taconite[a] | A | 0.2 | 23 |
| 2. | " | B | " | 30 |
| 3. | Taconite[b] | A | " | 50 |
| 4. | " | B | " | 69 |
| 5. | Copper[c] | A | " | 36–46[d] |
| 6. | " | B | " | 18 |
| 7. | Gold | A | " | 33 |
| 8. | " | B | " | 35 |
| 9. | Uranium | A | " | 41 |
| 10. | " | B | " | 28 |
| 11. | Iron[e] | A | " | 13 |
| 12. | " | B | " | 33 |
| 13. | Copper[f] | A | " | 38 |
| 14. | " | B | " | 37 |
| 15. | Gold | A | " | 98 |
| 16. | " | B | " | 95 |

A = Sodium 3-sulfoethyl polymethacrylate (SEM)
B = Copolymer of SEM and acrylamide, 4:1 mole % ratio, sodium salt form.
[a]Eleveth
[b]Sherman
[c] *Duval*
[d]range of several samples
[e]Hanna
[f]Morenci Substantial decreases in viscosity were also obtained with other concentrations and other homopolymers and copolymers. Subsequent evaluations of those agents substantially reducing the viscosity of the ore slurries in ore grinding operations at the same or lower concentrations indicated surprising and significant increases in grinding kinetics.

EXAMPLE 3

A ball mill, 19.5 centimeters (cm) internal diameter and about 20 cm in length, operated at about 60 rpm and containing about 110 one-inch steel balls, was utilized for grinding studies on various ores to determine the effectiveness of using grinding aids of the present invention. In such operations, the ore was crushed to pass through a 10 U.S. mesh screen and then mixed with appropriate amounts of water in the mill to form slurries of desired concentrations. Once the desired slurry concentration was formed, the mill was sealed and operated for various grinding periods, after which the resultant ground ore slurry was removed and the amount of particles passing through a 325 U.S. mesh screen determined. The trails were then repeated, using the same concentrations and grinding times, with the addition of various amounts of a grinding aid to the aqueous slurry prior to grinding. The results of such operations, indicating the effectiveness of the grinding aid in improving grinding kinetics, are set forth below:

TABLE VI

| Run No. | Grinding Aid | mg/gm Ore | Grinding Time mins | Wt. % Passing 325 Mesh | (a) % Increase | Ore Slurry % |
|---|---|---|---|---|---|---|
| 1. | None | 0 | 60 | 47.0 | — | 84% taconite(b) |
| 2. | A | 0.2 | 60 | 51.5 | 9.5 | 84% taconite(b) |
| 3. | A | 0.4 | 60 | 55.0 | 17. | 84% taconite(b) |
| 4. | None | 0 | 120 | 87.2 | — | 78% taconite(b) |
| 5. | A | 0.15 | 120 | 89.5 | 2.6 | 78% taconite(b) |
| 6. | None | 0 | 40 | 45.0 | — | 76% Copper(c) |
| 7. | A | 0.5 | 40 | 47.0 | 4.4 | 76% Copper(c) |
| 8. | A | 2.0 | 40 | 53.0 | 13.3 | 76% Copper(c) |
| 9. | None | 0 | 15 | 25.5 | — | 78% Copper(d) (coarse feed) |
| 10. | A | 0.2 | 15 | 28.0 | 9.8 | 78% Copper(d) (coarse feed) |
| 11. | None | 0 | 30 | 42.8 | — | 75% Copper(e) |
| 12. | A | 0.05 | 30 | 44.1 | 3. | 75% Copper(e) |
| 13. | A | 0.15 | 30 | 45.9 | 7.2 | 75% Copper(e) |
| 14. | A | 0.5 | 30 | 50.2 | 17.3 | 75% Copper(e) |

A = sodium polyacrylate, molecular weight of from about 5000 to 10,000.
(a) = % increase as compared with control
(b) = Mesabi Range ore
(c) = Duval ore, feed = 9% < 500 mesh
(d) = Duval ore, coarse feed = 5% < 500 mesh
(e) = Morenci ore The above data indicate that, with any fixed comparative grinding time, the weight percent passing 325 mesh is higher in all instances where a grinding aid was employed. A significant and surprising increase in the grinding kinetics was demonstrated even at low amounts of grinding aid (Run No. 5-2.6% increase with 0.015 weight percent of grinding aid), even where a relatively short grinding period was utilized (Run No. 12, 3% increase after 30 minutes with 0.005 weight percent grinding aid). Very dramatic and surprising increases in grinding are indicated for higher, but clearly economical, amounts of grinding aids. Increases of from about 10 to about 17% increases in the number and size of minus 325 mesh fragments being obtained with amounts ranging from 0.02 to 0.05 weight percent at grinding times of 15–60 minutes. Measurements at other particle sizes and ranges also indicated similar significant increases.

EXAMPLE 4

In procedures set forth as in Example 3, additional grinding aids were evaluated, the results being set forth below in Tables VII–X:

TABLE VII

| Run No. | Grinding Aid | mg/gm | Grinding Time mins | Wt. % Passing 325 Mesh | * % Increase | Ore Slurry % |
|---|---|---|---|---|---|---|
| 1. | None | 0 | 30 | 37.5 | — | 84% Taconite |
| 2. | **A | 0.5 | " | 38.0 | 1.3 | " |
| 3. | None | 0 | 60 | 47.0 | — | " |

TABLE VII-continued

| Run No. | Grinding Aid | mg/gm | Grinding Time mins | Wt. % Passing 325 Mesh | * % Increase | Ore Slurry % |
|---|---|---|---|---|---|---|
| 4. | A | 0.5 | " | 53.0 | 11.3 | " |

* = % increase as compared with control
**A = styrene-maleic anhydride; mol. wt. 2000; 1:1 mole % ratio, styrene to maleic anhydride; sodium salt.

The above data indicate that, with any fixed comparative grinding time, the weight percent passing 325 mesh is higher in instances where a grinding aid was employed. A significant increase in the grinding kinetics was demonstrated at low amounts of grinding aid even where a relatively short grinding period was utilized (Run No. 2, 30 minutes with 0.05 weight percent grinding aid). Very dramatic and surprising increases in grinding are indicated where longer grinding times are employed, an increase of more than 10% in the amount of ore passing through a 325 mesh screen being obtained after 60 minutes of grinding.

TABLE VIII

| Run No. | Grinding Aid | mg/gm | Grinding Time mins | Wt. % Passing 325 Mesh | * % Increase | Ore Slurry % |
|---|---|---|---|---|---|---|
| 1. | None | 0 | 30 | 37.5 | — | 84% Taconite*** |
| 2. | **A | 1.0 | " | 38.5 | 2.6 | 84% Taconite*** |
| 3. | None | 0 | 60 | 47.0 | — | 84% Taconite*** |
| 4. | A | 1.0 | " | 52.5 | 11.7 | 84% Taconite*** |
| 5. | None | 0 | 15 | 23. | — | 76% Gold |
| 6. | A | 0.8 | " | 24. | 4.3 | " |
| 7. | None | 0 | 30 | 33.5 | — | " |
| 8. | A | 0.8 | " | 37.5 | 11.9 | " |
| 9. | None | 0 | 45 | " | — | " |
| 10. | A | 0.8 | " | 45.0 | 20. | " |

* = % increase as compared with control
**A = Poly N(sulfomethyl)acrylamide, 100 mole % of amide groups substituted with sulfomethyl.
*** = Eleveth ore The above data indicate that, with any fixed comparative grinding time, the weight percent passing 325 mesh is higher in all instances where a grinding aid was employed. A significant and surprising increase in the grinding kinetics was demonstrated even at low amounts of grinding aid (Run No. 6-4.3% increase with 0.08 weight percent of grinding aid), even where a relatively short grinding period was utilized (15 minutes) and about a 12% increase after 30 minutes with the same weight percent of grinding aid (Run No. 8). Very significant increases of 20% are obtained after a grinding time of 45 minutes. Measurements at other particle sizes and ranges also indicated similar significant increases.

TABLE IX

| Run No. | Grinding Aid | mg/gm | Grinding Time mins | Wt. % Passing 325 Mesh | * % Increase | Ore Slurry % |
|---|---|---|---|---|---|---|
| 1. | None | 0 | 60 | 47.0 | — | 84% Taconite |
| 2. | **A | 1.0 | " | 49.5 | 5.3 | " |
| 3. | None | 0 | 16 | 23.5 | — | Copper*** |
| 4. | A | 0.2 | " | 24.5 | 4.2 | " |

TABLE IX-continued

| Run No. | Grinding Aid | mg/gm | Grinding Time mins | Wt. % Passing 325 Mesh | * % Increase | Ore Slurry % |
|---|---|---|---|---|---|---|
| 5. | None | 0 | 26 | 28.0 | — | " |
| 6. | A | 0.2 | " | 29.0 | 3.5 | " |

* = % increase as compared with control
**A = sodium salt of sulfonated copolymer of vinyl toluene and styrene, 3:1 mole ratio.
*** = 76% Duval copper ore.

The above data indicate that, with any fixed comparative grinding time, the weight percent passing 325 mesh is higher in all instances where a grinding aid was employed. A significant and surprising increase in the grinding kinetics was demonstrated even at low amounts of grinding aid (Run Nos. 7 & 9, 3.5 to 4.2% increases with 0.2 weight percent of grinding aid), even where a relatively short grinding period was utilized (16 and 26 minutes, respectively). Similar significant increases are also indicated for other particle sizes and ranges.

TABLE X

| Run No. | Grinding Aid | mg/gm | Grinding Time mins | wt. % Passing 325 Mesh | % Increase Over Control | Ore Slurry |
|---|---|---|---|---|---|---|
| 1. | None | — | 30 | 43.5 | — | 80% Taconite |
| 2. | A | 1.0 | " | 44.5 | 2.3 | " |
| 3. | None | — | 60 | 64. | — | " |
| 4. | A | 1.0 | " | 70. | 9.3 | " |
| 5. | None | — | 30 | 42. | — | 82% Taconite |
| 6. | A | 1.0 | " | 43. | 2.3 | " |
| 7. | None | — | 60 | 55.5 | — | " |
| 8. | A | 1.0 | " | 68.5 | 23.6 | " |
| 9. | None | — | 30 | 37.5 | — | 84% Taconite |
| 10. | A | 1.0 | " | 40. | 8. | " |
| 11. | None | — | 60 | 47. | — | " |
| 12. | A | 1.0 | " | 56. | 19. | " |

A = Sodium salt copolymer of sulfoethylmethacrylate (SEM) with acrylamide, 4:1 mole ratio SEM to acrylamide.

The foregoing data indicate the effectiveness of the present invention in increasing the amount of ore ground per unit of time, the weight percent passing through 325 mesh being higher in all instances. Even though relatively low amounts of the grinding aids were used (about 2 lb/ton), significant and surprising increases in the grinding kinetics were obtained.

Measurements of other particle sizes and ranges and other ores and coal also indicated similar significant increases. Other grinding aids of the invention are also similarly found to be effective in increasing grinding kinetics with the above and other ores and coal.

EXAMPLE 5

In other operations carried out according to the procedures of Example 3, 100% sulfoethyl methacrylate were evaluated as a grinding aid in a 72 wt. % slurry of Morenci ore. The grinding period was for 40 minutes. The wt. % or ore passing through a 325 (U.S.) mesh for the control was 50 wt. %. Of the test samples treated with 1.6 and 8.0 mg/gm of grinding, 56 and 62.5 wt. % of the ground ore was found to pass through the 325 mesh screen. As compared with the control, the grinding aids were found to result in increased grinding, the amount of ground material passing through the 325 mesh screen being increased 12 and 25%, respectively, as compared with the control.

To further illustrate the effectiveness of the chemical grinding aids of the present invention on an industrial scale, reference is made to the graphic representation illustrated in the drawing. The trail was conducted on taconite ore in an industrial scale overflow discharge rod grinding mill in which the ore was ground on a continuous circuit basis. The graph illustrates, along the vertical axis, the amount or throughput of ground ore at a constant (±1%) particle size of less than 35 mesh (U.S. Standard) which is discharged from the mill in tons per hour. The horizontal axis represents the percentage, by weight, of the solids present in the slurry.

Curve A represents the data obtained in performing a grinding run without the addition of a chemical grinding aid. An optimum range of grinding ore in an aqueous slurry without chemical addition is obtained between 80 to 82% solids in the slurry. Any further increase in the percentage of solids in the slurry quite expectedly necessitates a reduction in the throughput of the ore ground in order to match the constant percent less than 35 mesh of the product. Thus, at86% solids the throughput has fallen off to about 400 tons per hour from a previous high of about 410 tons at a solids concentration of about 80 to 82%.

Curve B represents the results of a grinding run in which a chemical grinding aid—sodium polyacrylate—was continuously added to the slurry in an amount of 0.13 lbs/ton of dry ore (0.065 mg/gm). The results were initially quite expected in that the addition of the grinding aid, at a concentration of 80 to 82% solids in the slurry, resulted in only a slight increase in throughput as compared to Run A in which no grinding aid was added to the slurry. What was entirely unobvious, however, was the sharp increase in the throughput when the percent solids concentration of the slurry was raised above 82%. Thus, at 84% solids, the throughput had increased to about 420 tons per hour while still maintaining the same percent less than 35 mesh in the product. At 86% the throughput reached about 450 tons per hour, which represents an increase of about 10% over the 82% solids level.

Curve C illustrates that an increase in the amount of the sodium polyacrylate grinding aid further increases the throughput particularly at a percent solids concentration in the slurry about 82%.

It is expected that a further increase in the percent solids concentration of the slurry above 86% will cause a gradual leveling off in the throughput and a subsequent fall-off at a percent solids concentration in the range above 90%. The actual trial was not conducted at a range above about 86% in order to avoid potentially serious problems in the operation of the rod mill caused by a tangling of the rods, a phenomena which is well known to persons skilled in the art.

The figure dramatically illustrates that the addition of the sodium polyacrylate grinding aid in this industrial scale trial in grinding taconite in a rod mill not only prevents a drop off in the throughput at a solids concentration above 82% but actually caused an increase in the throughput with an increase in the percent solids concentration of the slurry. This effect is completely unobvious and surprising in light of previous experience with grinding aids which were effective only to the extent of maintaining a relatively constant throughput with an increase in the percent solids concentration of the slurry, or which caused a slight increase in throughput but only with uneconomically large amounts of grinding aid chemical additions to the slurry.

In a laboratory scale batch test, taconite ore was ground in a mill in accordance with the procedure of Example 3. Sodium polyacrylate was evaluated as a grinding aid. The results are set forth in Table XI.

TABLE XI

| Runs[1] | Weight % Solids | Grams of Ore | Grams of Water | Sodium Poly-acrylate (mg/gm) | # Grams Less than 325 mesh in Feed | # Grams Less than 325 mesh after 45 minutes |
|---|---|---|---|---|---|---|
| 1 | 80 | 1884 | 471 | — | 156 | 1125 |
| 2 | 82 | 1994 | 437 | — | 165 | 1047 |
| 3 | 84 | 2111 | 402 | — | 175 | 969 |
| 4 | 84 | 2111 | 402 | 0.19 | 175 | 990 |
| 5 | 84 | 2111 | 402 | 0.28 | 175 | 1119 |

[1]All runs containing 0.5 mg of sodium silicate per gram of ore.

The foregoing data illustrates the effectiveness of the sodium polyacrylate grinding aid in Runs 4 and 5 in reversing the downward trend of fineness of grind of Runs 1 to 3 which were conducted without a grinding aid. As expected, with an increase in the weight percentage solids concentration in the aqueous slurry, the fineness of grind in the amount of ore ground decreases in Runs 1 to 3. However, the addition of the grinding aid at the relatively low concentration of only 0.19 mg/gm at the relatively high weight percent solids concentration resulted in an increase in fineness of grind. The further increase in fineness of grind was obtained in Run 5 with an increase in the amount of grinding aid to 0.28 mg/gm of ore.

In another laboratory scale batch test conducted in accordance with the procedure set forth in Example 3, sodium polyacrylate was evaluated as a grinding aid in the presence of a dispersant (sodium silicate) in the slurry. The results are set forth in Table XII.

TABLE XII

| Runs[1] | Weight % Solids | Grams of Ore | Grams of Water | Sodium Poly-acrylate (mg/gm) | # Grams Less than 325 mesh in Feed | # Grams Less than 325 mesh after 30 minutes |
|---|---|---|---|---|---|---|
| 1 | 73 | 1500 | 448 | — | 278 | 960 |
| 2 | 75 | 1500 | 500 | — | 278 | 870 |
| 3 | 77 | 1500 | 554 | — | 278 | 818 |
| 4 | 77 | 1500 | 554 | 0.75 | 278 | 863 |

[1]All runs containing 0.5 mg of sodium silicate per gram of ore.

The table dramatically demonstrates that the use of sodium silicate as a dispersant in an amount of 0.5 mg/gm of copper ore in each of Runs 1 to 4 does not overcome the expected reduction in the fineness of grind of ore particles after grinding for 30 minutes that is experienced in purely aqueous systems. In each of Runs 1 to 3, it can be seen that with an increase in the percent solids (by weight) in the slurry, the fineness of grind declined from 960 grams to 818 grams of particles having a size less than 325 mesh. With the addition of the sodium polyacrylate grinding aid in Run 4, the decrease was reversed and a substantial improvement in fineness of grind was obtained at the high slurry solids content.

As will be apparent from the foregoing specification and examples, the best mode for carrying out the invention in reversing trends towards lower grinding efficiency as the wt. % of ore increases is as described in the preferred embodiments concerning the grinding aids, the amounts thereof, the grinding trails and result (grinding kinetic increases) determination procedures. The best mode known for carrying out the invention with a preferred grinding aid (sodium polyacrylate) on an industrial scale is as exemplified in Example 5 hereof. In additional efforts to optimize the use of the grinding aids of the present invention, preliminary trials indicate that the effectiveness of a preferred grinding aidsodium polyacrylate—is enhanced if the pH of the slurry being ground is adjusted to higher levels, e.g., from about 8 to about 10 or more. Thus, in the grinding of certain ores where use of high slurry pH levels is beneficial and compatible with all aspects of the ore treating circuit concerned (i.e., flotation, etc.), such as the grinding of molybdenum, uranium, copper, etc., the best mode for using sodium polyacrylate appears to be in conjunction with the use of a base mixture of NaOH and $Na_2CO_3.H_2O$. While synergistic grinding results from the use of a poly(meth)acrylic acid—sodium carbonate grinding aid system are separately disclosed in pending application Ser. No. 853,735, filed Nov. 21, 1977, now abandoned and while use of the poly(meth)acrylic acid polymers with NaOH appears to result in increased grinding efficiency, the combined use of the grinding aid and two bases appears to give optimum results. Accordingly, where use of higher pH levels in a grinding circuit can be employed, it is believed the best presently known mode for using a grinding aid of the present invention is in conjunction with a base mixture of NaOH and $Na_2CO_3.H_2O$. Where sodium polyacrylate is the grinding aid and a taconite ore is being ground, it appears the best mode comprises the use of 0.2 mg of the grinding aid per gm of ore with from about 0.3 to about 0.4 mg of combined $Na_2CO_3.H_2O$-NaOH base mixture (usually equal amounts of each) per gram of ore.

While this invention has been described with reference to certain specific embodiments, it is of course to be understood that the invention is not to be so limited except insofar as appear in the accompanying claims.

We claim:

1. A process for grinding coal or ores containing metal values comprising carrying out said grinding in the presence of a liquid medium and a grinding aid comprising an anionic polyelectrolyte dispersible in said medium and having a polyethylenic backbone and a plurality of pendant anionic groups, said grinding aid being employed in an amount effective to provide increased grinding efficiency.

2. The process of claim 1 wherein the proportion of anionic groups in the polyelectrolyte range from about 1 to about 14 milliequivalents of anionic moiety per gram of electrolyte.

3. The process of claim 2 wherein the proportion of anionic groups in the polyelectrolyte range from about 2 to about 12 milliequivalents of anionic moiety per gram of polyelectrolyte.

4. The process of claim 1 wherein the pendant anionic groups on the polyethylenic backbone have a pKa of about 8 or less.

5. The process of claim 2 wherein the pendant anionic groups on the polyethylenic backbone have a pKa of about 6 or less.

6. The process of claim 3 wherein the pendant anionic groups on the polyethylenic backbone have a pKa of about 6 or less.

7. The process of claim 1 wherein the anionic groups are carboxylate or sulfonate.

8. The process of claim 4 wherein the anionic groups are carboxylate or sulfonate.

9. The process of claim 1 wherein the polyelectrolyte is a water-dispersible polymer or copolymer of anionic monomers.

10. The process of claim 9 wherein said polyelectrolyte is a polymer of alpha,beta-ethylenically unsaturated carboxylic acids, partial esters of alpha,beta-ethylenically unsaturated polycarboxylic acids, N-sulfoalkyl derivatives of alpha,beta-ethylenically unsaturated amides, sulfoalkyl esters of alpha,beta-ethylenically unsaturated carboxylic acids, alpha,beta-ethylenically unsaturated aromatic sulfonic acids, including copolymers of at least one of the aforementioned monomers with at least one other ethylenically unsaturated monomer; sulfonated monovinylidene aromatic polymers; or sulfonated aliphatic monoolefinic polymers.

11. The process of claim 1 wherein the polyelectrolyte has a molecular weight of from about 200 to about 100,000.

12. The process of claim 1 wherein the polyelectrolyte has a molecular weight of from about 1000 to about 60,000.

13. The process of claim 1 wherein the polyelectrolyte has a molecular weight of from about 2000 to about 20,000.

14. The process of claim 1 wherein ores containing metal values are ground.

15. The process of claim 1 wherein coal is ground.

16. The process of claim 14 wherein the ore is an iron ore.

17. The process of claim 14 wherein the ore is a copper ore.

18. The process of claim 14 wherein the ore is a gold ore.

19. The process of claim 10 wherein the polyelectrolyte is a polymer of alpha,beta-ethylenically unsaturated carboxylic acids or the partial esters of alpha-beta-ethylenically unsaturated polycarboxylic acids.

20. The process of claim 19 wherein ores containing metal values are ground.

21. The process of claim 19 wherein coal is ground.

* * * * *

UNITED STATES PATENT AND TRADEMARK OFFICE

CERTIFICATE OF CORRECTION

PATENT NO. : 4,274,599

DATED : June 23, 1981

INVENTOR(S) : Willy Manfroy and Richard R. Klimpel

It is certified that error appears in the above—identified patent and that said Letters Patent is hereby corrected as shown below:

Column 1, line 15, delete "or" after the word "grinding and insert -- of --;

Column 1, line 33, delete "along" and insert -- alone --;

Column 1, line 34, insert -- metals -- after "winning";

Column 1, line 62, delete "least" and insert -- best --;

Column 2, line 62, delete "said" and insert -- aids --;

Column 3, line 44, delete "polyelectric" and insert -- polyethylenic --;

Column 4, line 13, "polyelectrolyte" should be plural;

Column 4, line 16, at the beginning of the line insert -- carboxylic --;

Column 4, line 61, "salt" should be plural;

UNITED STATES PATENT AND TRADEMARK OFFICE

CERTIFICATE OF CORRECTION

PATENT NO. : 4,274,599

DATED : June 23, 1981

INVENTOR(S) : Willy Manfroy and Richard R. Klimpel

It is certified that error appears in the above—identified patent and that said Letters Patent is hereby corrected as shown below:

Column 5, line 17, delete "of" and insert -- or --;

Column 6, line 20, delete "Throughout" and insert -- Throughput --;

Column 7, line 22, delete "or" and insert -- of --;

Column 8, line 8, "slurries" is misspelled;

Column 8, line 10, delete "polyacrylic" and insert -- polyacrylate --;

Column 8, Table I, Ore #11, under column titled "Aid" the word "acrylamide" is misspelled;

Column 8, Table I, Ore #13, under column titled "Aid" the word "polyacrylate" is misspelled;

Column 8, line 55, the period should be replaced with a comma;

UNITED STATES PATENT AND TRADEMARK OFFICE

CERTIFICATE OF CORRECTION

PATENT NO. : 4,274,599

DATED : June 23, 1981

INVENTOR(S) : Willy Manfroy and Richard R. Klimpel

It is certified that error appears in the above—identified patent and that said Letters Patent is hereby corrected as shown below:

Columns 9 and 10, Table IV, the word "polystyrene" has been misspelled several times throughout the Table;

Column 10, line 63, delete "trails" and insert -- trials --;

Column 13, line 60, delete "were" and insert -- was --;

Column 13, line 62, delete "or" and insert -- of --;

Column 14, line 60, delete "prevents" and insert -- prevented --;

Column 15, line 68, delete "trails" and insert -- trials --;

Column 18, Claim 19, line 18, the hyphen between "alpha" and "beta" should be deleted and a comma inserted instead.

Signed and Sealed this

First Day of December 1981

[SEAL]

Attest:

GERALD J. MOSSINGHOFF

Attesting Officer

Commissioner of Patents and Trademarks